United States Patent [19]

Montier et al.

[11] Patent Number: 4,616,569

[45] Date of Patent: Oct. 14, 1986

[54] ARMOR PENETRATING PROJECTILE

[75] Inventors: Patrick Montier, Bourges; Jean-Claude Sauvestre, St. Doulchard, both of France; Karl W. Bethmann, Moers, Fed. Rep. of Germany; Bernhard Bisping, Ratingen, Fed. Rep. of Germany; Peter Wallow, Düsseldorf, Fed. Rep. of Germany

[73] Assignees: Rheinmetall GmbH, Dusseldorf, Fed. Rep. of Germany; L'Etat Francais represente par le Delegue General pour l'Armement Bureau des Brevets et Inventions, Paris Armes, France

[21] Appl. No.: 474,284

[22] Filed: Mar. 11, 1983

[30] Foreign Application Priority Data

Mar. 11, 1982 [DE] Fed. Rep. of Germany ..... 3208809

[51] Int. Cl.[4] ..... F42B 11/00

[52] U.S. Cl. ..... 102/517; 102/501

[58] Field of Search ..... 102/501, 517–519, 102/491–497, 482, 703; 376/296

[56] References Cited

U.S. PATENT DOCUMENTS

| | | | |
|---|---|---|---|
| 371,461 | 10/1887 | Kennedy | 102/519 |
| 451,088 | 4/1891 | Tunnicliff | 102/506 |
| 644,361 | 2/1900 | Luciani | 102/519 |
| 3,877,380 | 4/1975 | Riparbelli | 102/519 |
| 3,893,270 | 7/1975 | Schupack et al. | 376/296 |
| 3,979,234 | 9/1976 | Northcutt, Jr. et al. . | |
| 4,123,975 | 11/1978 | Mohaupt | 102/518 |
| 4,256,039 | 3/1981 | Gilman | 102/519 |
| 4,366,015 | 12/1982 | Murray | 102/527 |

*Primary Examiner*—Harold J. Tudor

[57] ABSTRACT

An armor-penetrating projectile comprises an outer substantially cylindrically tubular member of great length/diameter ratio and density, centered on an axis, and having an axially throughgoing bore defined by an inner surface and an axially elongated inner member of greater strength and elasticity than the outer member extending axially through the bore the full length of the outer member and having an outer surface in tight radial contact with the inner surface of the outer member at at least a plurality of annular locations spaced along the axis. This inner member can be a bundle of wires that is inserted through the bore after the outer member has been expanded by heat, then twisted and longitudinally prestressed to lock tightly in the outer member.

3 Claims, 3 Drawing Figures

ARMOR PENETRATING PROJECTILE

FIELD OF THE INVENTION

The present invention relates to an armor-piercing projectile or penetrator bullet. More particularly this invention concerns a multipart projectile intended to penetrate even heavy armor.

BACKGROUND OF THE INVENTION

An armor-penetrating projectile of great length-/diameter ratio and density is known which has a front part formed as an outer substantially cylindrically tubular member centered on an axis and having an axially throughgoing bore defined by an inner surface and an axially elongated inner member of greater strength and elasticity than the outer member extending axially through the bore the full length of the outer member.

As described in German patent document No. 2,743,732 (which corresponds to coassigned U.S. patent application Ser. No. 949,067, filed Sept. 15, 1978, which has been abandoned in favor of coassigned continuation-in-part application Ser. No. 412,794, filed Aug. 23, 1982) the front region of such a penetrator is formed of a stack of heavy rings and the inner member is formed as a bolt screwed at its axially rear end into the front of a main penetrator body. The bolt is formed level with each joint between two adjacent rings with a weakening or break groove. Thus when the penetrator first impinges the armored target the rings will break apart in controlled manner, and the mass of the main body behind them will increase the impact.

Unfortunately the violence of firing such a shell frequently is too great for the main penetrator to withstand, so it breaks up in flight. Its inertia is therefore lost to the front portion. Without the extra mass of the main body the shell is ineffective against new laminated armor.

In order to overcome this breaking-up problem it is standard to surround the heavy sintered-metal penetrator with a steel casing. In order to secure the casing at the rear to the charge carrier it is necessary to thread it, and such threads can only be cut in a relatively thick-walled casing. As a result this casing takes up a considerable portion of the volume of the shell, taking the place of denser and more effective armor-piercing material.

OBJECTS OF THE INVENTION

It is therefore an object of the present invention to provide an improved penetrator projectile.

Another object is the provision of such a penetrator projectile which overcomes the above-given disadvantages, that is which is not liable to breaking up in flight.

A further object is to provide an improved method of making such a projectile.

SUMMARY OF THE INVENTION

These objects are attained according to the instant invention in a n armor-penetrating projectile comprising an outer substantially cylindrically tubular member of great length/diameter ratio and density, centered on an axis, and having an axially throughgoing bore defined by an inner surface and an axially elongated inner member of greater strength and elasticity than the outer member extending axially through the bore the full length of the outer member and having an outer surface in tight radial contact with the inner surface of the outer member at at least a plurality of annular locations spaced along the axis.

With this system even if the penetrator cracks through perpendicular to its axis it will hold together. Such perpendicular cracking is particularly likely, as the firing force is axial and on firing the projectile is radially contained in the breech and barrel. In addition the inner member can be of relatively small volume so that the shell can be as dense as possible for its volume.

According to a feature of this invention the inner member is at least partially formed of wire. It can be formed for maximum strength of a bundle of wires that are twisted together.

The inner member according to this invention has a plurality of axially spaced thickened regions having cylindrical outer surfaces engaging the inner bore surface. These thickened regions are of a ductile material carried on the wire. A shock-absorbing copper alloy is ideal. In this arrangement the contact locations are annularly continuous.

When the inner member is formed of a bundle of such wires the locations are annularly discontinuous. In fact in this arrangement each such location is formed by a plurality of sections of a number of helical contact regions each formed between one wire and the inner bore surface. These helical contact regions can be quite long.

The method according to this invention comprises the steps of first heating the outer member to increase the diameter of the bore to a size greater than the maximum outer diameter of the inner member, then inserting the inner member axially through the bore of the outer member, and finally cooling the outer member to shrink the inner surface thereof into tight radial engagement with the inner member at the locations. Such a shrink fit creates an extremely tight surface contact that will ensure excellent holding power between the inner and outer members.

To maximize the strength of this arrangement the inner member is axially tensioned after inserting it through the outer member and until the inner surface has been shrunk onto the inner member. Furthermore when the inner member is formed as a group of flexible wires, the method further comprises the steps after inserting the inner member of first twisting the wires and then holding the wires in twisted condition until the outer member cools.

DESCRIPTION OF THE DRAWING

The above and other features and advantages will become more readily apparent from the following, reference being made to the accompanying drawing in which.

SPECIFIC DESCRIPTION

Figure 1:
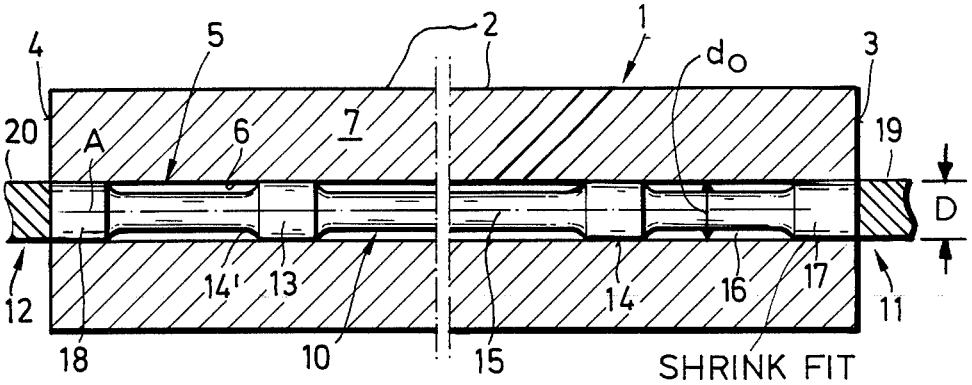
FIG. 1 is an axial section through a projection according to the invention.

As seen in FIG. 1 a penetrator 1 is centered on an axis A and is of relatively great axial length and relatively small radial width. It has a cylindrically tubular outer member 7 formed of sintered heavy-metal material so as to have considerable density and forming a cylindrical outer surface 2 centered on the axis A, front and rear planar end surfaces 3 and 4 perpendicular to the axis A, and a central axially throughgoing bore 5 also centered on the axis A and having an inner surface 6.

Coaxially received in this bore 5 is an inner member 10 having a wire core 15 of somewhat greater strength than the tube 7 and provided with thickened or large-diameter portions 13 having cylindrical outer surfaces in very tight radial engagement with the inner surface 6 of the bore 5. This core 15 has end portions 17 and 18 identical to the portions 14 and tightly fitted in the leading and trailing ends of the bore 5 and formed with outwardly projecting ends 11 and 12 having respective screwthreads 19 and 20. The transition regions 14' at the ends of the thickened parts 13, 17, and 19 are rounded for best force transmission.

This penetrator 1 is made by heat shrinking the outer member 7 on the inner member 10. The normal diameter of the inner surface 6 of the bore 5 of the outer member 7 is $d_o$. The normal diameter of the outer surfaces 14 of the portions 13, 17, and 18, however, is D, which is slightly greater than $d_o$. To fit the two together the outer member 7 is heated so it has an inner diameter of $d_1$ which is greater than D. Then the member 10, which may be cooled to reduce its diameter, is inserted axially through the bore. Nuts may be threaded over the two ends 11 and 12 before the two members 7 and 10 have reached the same temperature so as to axially prestress the two relative to each other with axial stretching of the member 10 and compression of the member 7.

Once the two members 7 and 10 are at the same temperature they will be very solidly locked together. Any cracking at the empty regions 16 between the thickened regions 13, 17, and 18, which are axially regularly spaced along the penetrator 1, will not cause the outer member 7 to go to pieces. Instead the individual pieces will be carried on the strong core part 10.

Figure 2:
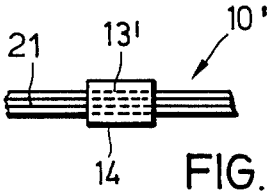
FIG. 2 is a large-scale side view of an inner member according to the invention.

FIG. 2 shows a core part 10' formed of a plurality of wires 21 provided with a thickened region 13' having the outer surface 14. This element 13' can be a copper-based alloy that is cast directly on the wires 21 or fitted as a sleeve over them and swaged into tight contact therewith. Such a copper alloy makes good surface contact with the harder tube 7 and is ductile enough to absorb shock somewhat.

Figure 3:
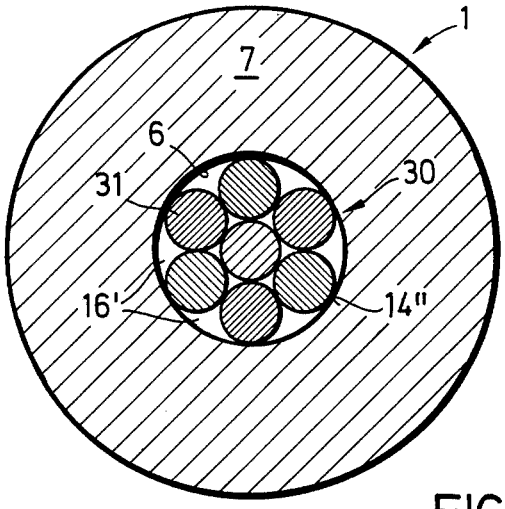
FIG. 3 is a cross section through another projectile in accordance with this invention.

FIG. 3 shows an inner element 30 formed of a plurality of helically twisted wires 31, cable-fashion. This defines helical spaces 16' and all-around contact surfaces 14'' that are annular and lie on a cylinder, but that are not circumferentially continuous.

This last-described arrangement is made by first heating the tube 7 as described above. Then the seven wires 31 are inserted through the bore 5, longitudinally tensioned, and twisted. The result is an extremely rugged structure since the outer diameter of the core 30 increases as it is twisted, while the inner diameter of the surface 6 decreases as the tube 7 cools. Once fully cool the system will therefore also be axially prestressed.

When the penetrator strikes an object the tube 7 will fracture perpendicular to the axis A. The individual pieces will, however, remain connected together so their mass will be effective. Since the core 1 is relatively small and is in the center of the projectile, the sharp edges of the massive outer tube 7 will be effective on the target. The volume of this member 10 is much smaller than the normally employed steel casing, so more high-density material can be packed into the shell.

The projecting front end 11 can serve for mounting any type of shell tip or flight stabilizer. Similarly the threaded rear end 12 can serve for mounting stabilizing fins or the like.

We claim:

1. An armor-penetrating projectile comprising:

an outer substantially cylindrically tubular member of great length/diameter ratio and density, centered on an axis, and having an axially throughgoing bore defined by an inner surface; and an axially elongated inner member of greater strength and elasticity than the outer member extending axially through the bore the full length of the outer member and having an outer surface in tight radial shrink-fit contact with the inner surface of the outer member at least a plurality of annular locations spaced along the axis, said inner member is at least partially formed of a bundle of wires; and wherein the inner member is formed with a plurality of axially spaced thickened regions having cylindrical outer surfaces engaging the inner bore surface.

2. The projectile defined in claim 1 wherein the thickened regions are of a ductile material carried on the wire.

3. The projectile defined in claim 1 wherein the inner member is formed of a bundle of wires which are twisted together and said thickened regions are annularly discontinuous.

* * * * *